US012434937B2

(12) United States Patent
Dettori et al.

(10) Patent No.: US 12,434,937 B2
(45) Date of Patent: Oct. 7, 2025

(54) FOLDING OR INTERFOLDING UNIT FOR FOLDING OR INTERFOLDING SHEETS OF PAPER

(71) Applicant: KÖRBER TISSUE FOLD S.R.L., Lucca (IT)

(72) Inventors: Daniele Dettori, Capannori (IT); Graziano Dini, Bagni di Lucca (IT); Massimo Bianchi, Viareggio (IT)

(73) Assignee: KÖRBER TISSUE FOLD S.R.L., Porcari (IT)

( * ) Notice: Subject to any disclaimer, the term of this patent is extended or adjusted under 35 U.S.C. 154(b) by 79 days.

(21) Appl. No.: 18/287,369

(22) PCT Filed: Apr. 20, 2022

(86) PCT No.: PCT/IB2022/053678

§ 371 (c)(1),
(2) Date: Oct. 18, 2023

(87) PCT Pub. No.: WO2022/224155

PCT Pub. Date: Oct. 27, 2022

(65) Prior Publication Data

US 2024/0208766 A1 Jun. 27, 2024

(30) Foreign Application Priority Data

Apr. 22, 2021 (IT) ..... 102021000010283

(51) Int. Cl.
*B65H 45/20* (2006.01)
*B65H 45/24* (2006.01)

(52) U.S. Cl.
CPC ..... *B65H 45/20* (2013.01); *B65H 45/24* (2013.01); *B65H 2403/51* (2013.01); *B65H 2406/34* (2013.01)

(58) Field of Classification Search
CPC .. B31F 1/10; B65H 5/22; B65H 45/10; B65H 45/101; B65H 45/20; B65H 45/165;
(Continued)

(56) References Cited

U.S. PATENT DOCUMENTS 5,088,707 A * 2/1992 Stemmler ..... B65H 45/28 270/32
5,147,273 A * 9/1992 Rottmann ..... B65H 45/24 493/430

(Continued)

FOREIGN PATENT DOCUMENTS

EP 1 457 444 A2 9/2004
EP 1 520 819 A1 4/2005

(Continued)

*Primary Examiner* — Leslie A Nicholson, III
(74) *Attorney, Agent, or Firm* — Maschoff Brennan

(57) ABSTRACT

A folding or interfolding unit includes first and second folding or interfolding rolls to fold or interfold the sheets of paper according to a predetermined folding or interfolding configuration. The first and second folding or interfolding rolls include, respectively, a tubular body configured to rotate in a predetermined direction of rotation about a longitudinal rotation axis, and gripping groups, each of which includes a mechanical gripping member configured to move, at a gripping point, from an opening position to a closing position, which is arranged to mechanically hold the sheets up to a releasing point. Each gripping group includes at least one suction hole associated to each mechanical gripping member. A vacuum distribution device selectively pneumatically connects at least one suction hole at a time to a device for generating a predetermined vacuum degree, to cause the sheets of paper to adhere between starting and ending positions.

13 Claims, 10 Drawing Sheets

(58) Field of Classification Search
CPC .... B65H 45/16; B65H 45/24; B65H 2403/51; B65H 2406/34; B65H 2406/345
USPC ..... 270/39.01, 39.05, 39.06, 39.09
See application file for complete search history.

(56) References Cited

U.S. PATENT DOCUMENTS

| | | | | |
|---|---|---|---|---|
| 7,517,309 | B2 * | 4/2009 | De Matteis | B65H 45/24 493/411 |
| 8,123,665 | B2 * | 2/2012 | De Matteis | B65H 29/6618 493/413 |
| 9,862,562 | B2 * | 1/2018 | Butterworth | B65H 45/24 |
| 10,543,674 | B2 * | 1/2020 | Bormann | B31B 70/146 |

FOREIGN PATENT DOCUMENTS

| | | | |
|---|---|---|---|
| WO | 2004/071921 | A1 | 8/2004 |
| WO | 2019/207434 | A1 | 10/2019 |

* cited by examiner

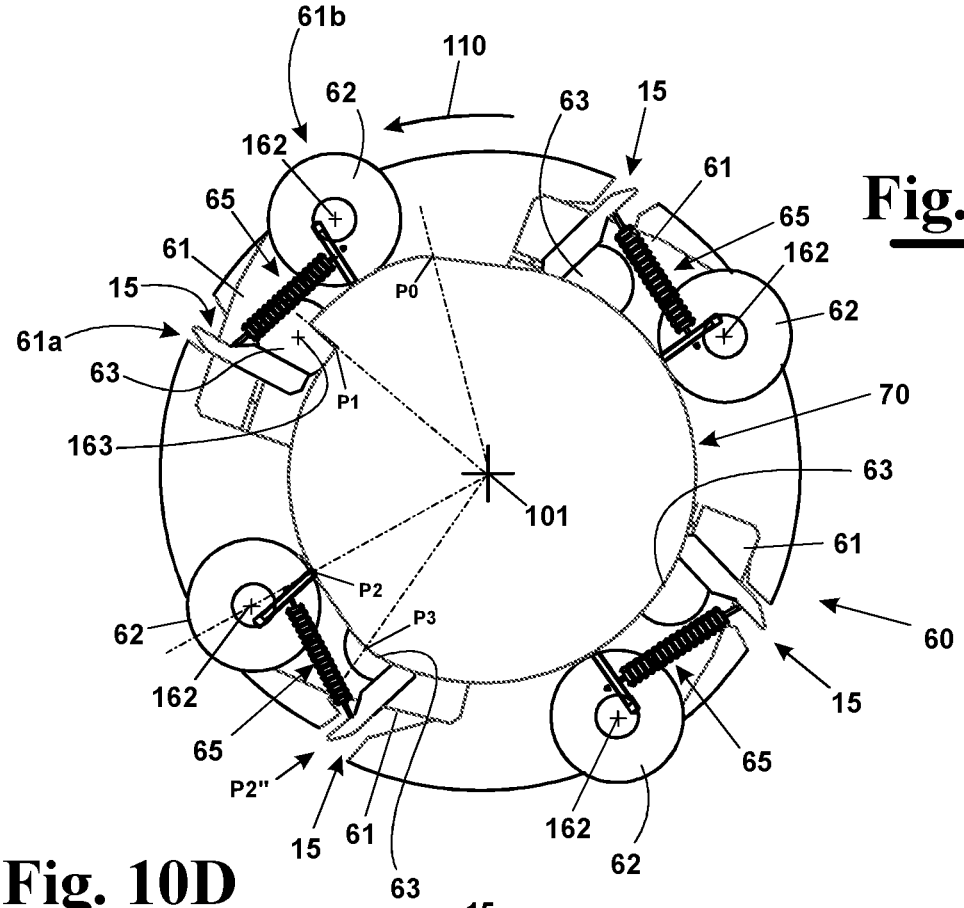
Fig. 10C
Fig. 10D
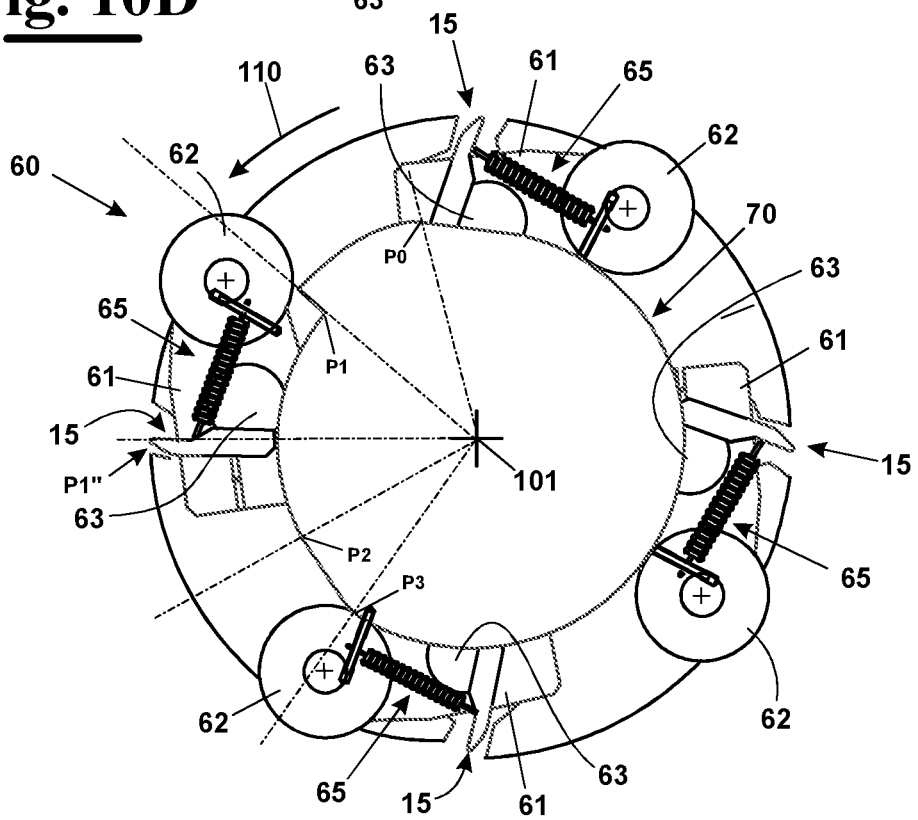

FOLDING OR INTERFOLDING UNIT FOR FOLDING OR INTERFOLDING SHEETS OF PAPER

DESCRIPTION

Field of the Invention

The present invention relates to the paper converting field and similar products, and in particular it relates to a folding or interfolding unit of sheets of paper of a folding or interfolding machine of sheets of paper.

Description of the Prior Art

As known, folding and interfolding machines exist provided with systems for causing the worked sheets of paper to adhere on the surface of the rolls, in order to guide them along a predetermined trajectory to carry out the fold according a determined folding or interfolding configuration.

The systems that carry out the aforementioned adhesion provide mechanical pliers, or alternatively, pneumatic suction systems.

The holding systems of mechanical type normally provide pliers distributed along the circumference of the folding roll and arranged to selectively and alternatively move between catching configuration and a releasing configuration of the worked web or sheet. The succession of the catching and releasing steps of the sheets by the two folding or interfolding rolls, allows to carry out a determined number of folds on the worked web, or sheets.

Patent No. EP1520819 describes, for example, an interfolding machine where the folding rolls are equipped with pliers and wedges in such a way that the wedge of a folding roll can introduce the sheets into a respective pliers of the other folding roll. The wedges must have two degrees of freedom, a swinging and a radial motion, in order to be able to fit with the pliers arranged on the other roll with which they cooperate. However, the mechanical systems are not able to work at high speed because the devices of a roll causing the introduction of the web or sheet of paper into the pliers of the other roll as well as the actuation devices of mechanical type which cause the pliers e from the catching configuration to the releasing configuration and vice versa, are not able to work synchronously at high speed. Furthermore, these devices are very complicated, expensive and need a frequent maintenance due to the wear of the wedges and their breaking that frequently occur.

In the case of pneumatic suction systems a device is provided for generating a predetermined vacuum degree, normally a vacuum pump, pneumatically connected to the inner part of the suction roll. More precisely, the surface of the suction roll is provided with a determined number of rows of suction holes distributed on the roll surface in such a way to cause the worked web, or sheet, to adhere only at determinate portions. Normally, a suction roll is provided with 3, or 4, close couples of rows of suction holes positioned at 120°, or 90°, with respect to each other, and pneumatically connected to the device for generating a predetermined vacuum degree at determined angular positions of the suction roll, in such a way to cause the worked web or sheet of paper to adhere at a determined sector of the surface of the suction roll.

A kind of suction rolls is, for example, described in EP1457444. In particular, the folding roll comprises a tubular body provided with the aforementioned plurality of rows of holes, for example 4 couples of rows of holes positioned at 90° with respect to each other and configured to rotate during working conditions about a longitudinal axis. The suction roll is, furthermore, provided with a second tubular body mounted within the aforementioned tubular body and coaxially to it. In particular, the inner tubular body is pneumatically connected with a device for generating a predetermined vacuum degree, and two sealing members are, furthermore, provided extending longitudinally between the aforementioned tubular bodies at opposite sides of the, or each, aperture. In this way, the inner tubular body, the internal surface of the external tubular body and the two longitudinal sealing members, define a suction chamber at a determined position of the suction roll. Therefore, the web or sheet of paper is sucked by the suction chamber at a first point P1 having a first predetermined angular position, at which a longitudinal row of suction holes is positioned for the rotation of the external tubular body at the aforementioned suction chamber, or, more precisely, immediately downstream of the first sealing member. The web or sheet of paper is instead, then, released at a second point P2, having 10 second predetermined angular position, at which the aforementioned longitudinal row of suction holes is positioned by the rotation of the external tubular body at a position external to the aforementioned suction chamber, or, more precisely, immediately downstream of the second sealing member. Therefore, the web or sheet of paper is retained on the portion of the surface of the suction roll comprised between the first and the second point P1 and P2 to carry out the aforementioned cutting or folding operation, or the movement along the machine.

However, the solution described in EP1457444, as well as other analogous prior art solutions has some drawbacks.

In particular, the speed at which the web or sheet of paper is folded, or interfolded, by the folding unit, cannot exceed a predetermined advancing speed threshold value, normally about 250-300 m/min, value that is dictated by the constructional and functioning limitations of determined components of the machine.

In fact, if the aforementioned speed values are not met, during the functioning of the machine, drawbacks of different nature can occur. In particular, if the aforementioned threshold values are exceeded, due to the inertia of the paper, the worked web or sheet, remains adhered to the surface of the suction roll also after the second angular position, that means to a portion of the surface that is positioned downstream of the second sealing member. This causes a fold of the web or sheet of paper that is not accurate and besides unavoidably compromising the quality of the final product, in particular forming unwanted folds, can also causes jamming of the paper that obliges to stop the machine to remove the jammed paper with consequent loss of time and productivity.

Therefore, in order to avoid the aforementioned working and quality problems of the final product it is necessary to operate at predetermined speeds beyond which is not possible to work.

In WO2019/207434 a folding roll is described provided with a clamping member, which is arranged longitudinally to the roll. It is, furthermore, provided a piezoelectric actuator to operate a swinging motion of the clamping member about a swinging axis parallel to the rotation axis of the folding roll.

However, the solution described in WO2019/207434 provides to use complex electronic circuits to operate the piezoelectric actuator in a controlled way and a complex processing system of the signals in real time. Furthermore, the piezoelectric actuator can have instability problems due to a not perfect time modelling and to the vibration modes of the structure. All this can compromise the quality of the final product because it is not able to assure a perfect synchronism with the other devices with which the folding rolls cooperate.

In addition to the above, the solution of WO2019/207434 involves high installation and management costs owing to the great number of maintenance interventions that are necessary to guarantee the effectiveness of the opening and closing systems of the clamping members.

SUMMARY OF THE INVENTION

It is, therefore, an object of the present invention to provide a folding or interfolding unit which is able to overcome the aforementioned drawbacks of the folding or interfolding units of prior art.

It is, in particular, an object of the present invention to provide a folding or interfolding unit that is structurally easier than those of prior art, that is able to produce a final product of excellent quality also at high advancing velocity of the web or sheet of paper along the machine, in particular higher than 300 m/min.

These and other objects are achieved by a folding or interfolding unit of a plurality of sheets of paper, comprising:

- a first and a second folding or interfolding roll configured to fold or interfold said plurality of sheets of paper according to a predetermined folding or interfolding configuration, at a folding or interfolding zone, each said first and second folding or interfolding roll comprising:
  - a tubular body configured to rotate in a predetermined direction of rotation about a longitudinal rotation axis oriented along a horizontal direction;
  - a plurality of gripping groups each of which comprising:
    - a mechanical gripping member comprising a movable part and a fixed part, said movable part being configured to move, at a gripping point (P1") a having first predetermined angular position, from an opening position to a closing position with respect to said fixed part, said mechanical gripping member in said closing position being arranged to mechanically hold said or each sheet of said plurality of sheets up to a releasing point (P2") having second a predetermined angular position;
    - at least one suction hole associated to each mechanical gripping member and configured to cause said or each sheet of paper to be sucked between a position of starting suction (P1') and a position of ending suction (P2') to introduce the same into said mechanical gripping member;
  - an actuation group configured to cause one movable element at a time to move from said opening position to said closing position and vice versa;

whose main characteristic is that said actuation group comprises:

- an opening device configured to selectively cause one movable element at a time to move from said closing position to said opening position, at said releasing point (P2");
- a closing device configured to cause one movable element to move from said opening position to said closing position at said gripping point (P1");

and that said opening device is a cam device.

Other technical characteristics of the present invention and the related embodiments are set out in the dependent claims.

In particular, a vacuum distribution device can be furthermore provided configured to selectively pneumatically connect at least one suction hole at a time of said first and of said second folding or interfolding roll to a device for generating a predetermined vacuum degree in such a way to cause said or each sheet of paper to be sucked between the aforementioned position of starting suction (P1') and the aforementioned position of ending suction (P2').

Preferably, each folding or interfolding roll, comprises, furthermore a fixed tubular body positioned coaxially to the aforementioned tubular body, the fixed tubular body being provided with an external lateral surface and with an internal lateral surface pneumatically connected to each other by at least an aperture and having a longitudinal cavity pneumatically connected to each other with the aforementioned device for generating a predetermined vacuum degree.

In particular, the aforementioned vacuum distribution device comprises a suction chamber pneumatically connected to the aforementioned longitudinal cavity and delimited by an internal lateral surface of the aforementioned tubular body and laterally by a first and a second sealing member to extend longitudinally to the aforementioned tubular body. More in particular, the aforementioned suction chamber is configured to selectively pneumatically connect the aforementioned longitudinal cavity to a suction hole at a time between the first and the second predetermined angular position (P1', P2').

BRIEF DESCRIPTION OF THE DRAWINGS

The invention will now be shown with the following description of its exemplary embodiments, exemplifying but not limitative, with reference to the attached drawings in which:

FIG. 2 diagrammatically shows a transverse section view of one possible embodiment of a folding or interfolding roll, of which the folding or interfolding unit of FIG. 1 can be equipped with;

FIG. 8 diagrammatically shows a transverse section view of another possible embodiment of a folding or interfolding roll, of which the folding or interfolding unit according to the invention can be equipped with;

FIGS. 10A to 10D diagrammatically show a possible operative sequence carried out by an embodiment foreseen by the invention of an actuation group of a folding, or suction roll;

DETAILED DESCRIPTION OF SOME EXEMPLARY EMBODIMENTS OF THE INVENTION

Figure 1:
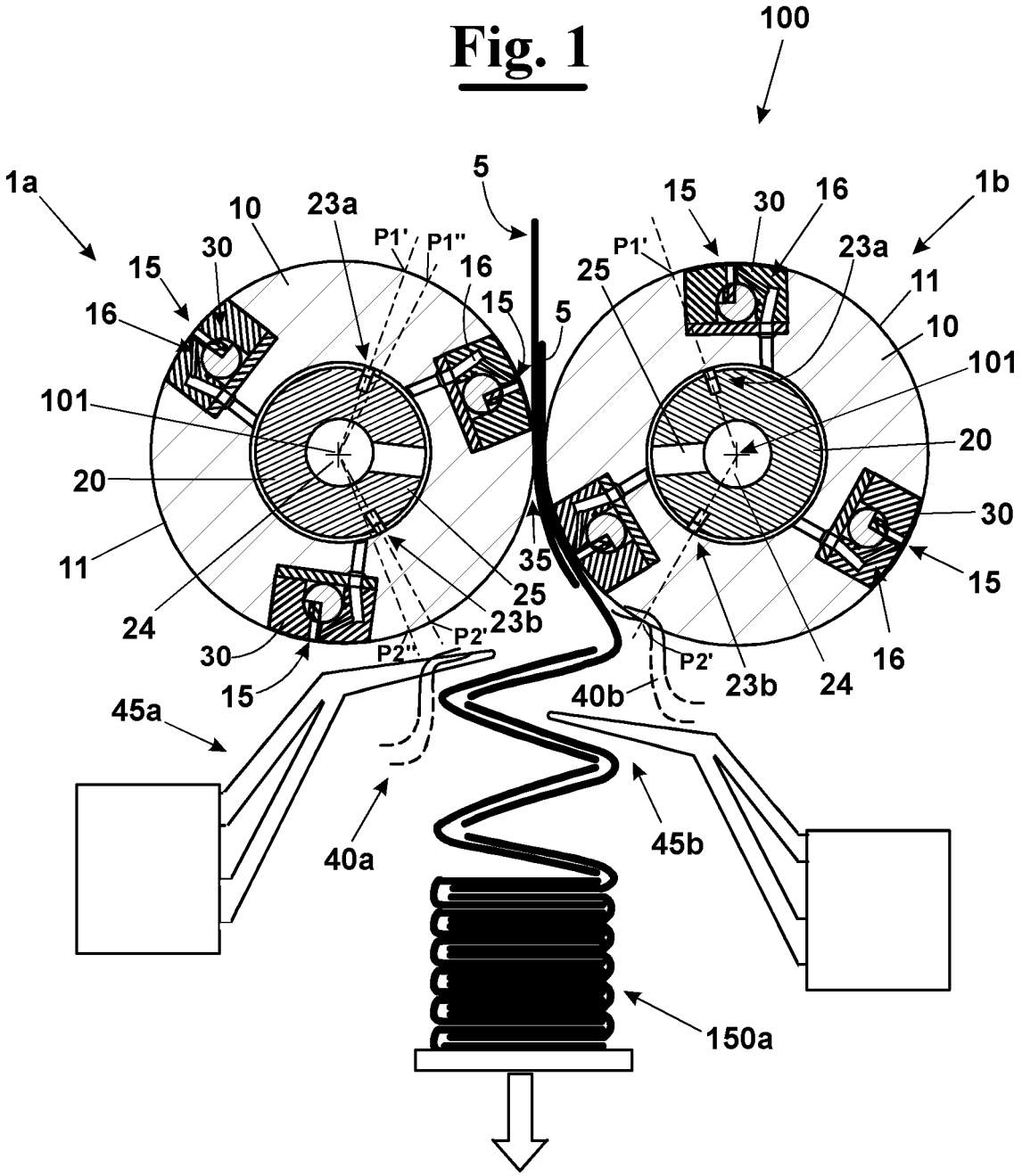
FIG. 1 diagrammatically shows a side elevation partly sectioned view of a first embodiment of a folding or interfolding unit according to the invention.

As diagrammatically shown in FIG. 1, a first embodiment of a folding or interfolding unit 100, according to the invention, for folding or interfolding a plurality of sheets of paper 5 comprises a first and a second folding or interfolding roll 1*a* and 1*b* configured to fold or interfold the aforementioned plurality of sheets of paper 5 according to a predetermined folding or interfolding configuration, at a folding or interfolding zone 35. In particular, each of the first and the second folding or interfolding roll 1*a* and 1*b* comprises a tubular body 10 provided with an external lateral surface 11 and configured to rotate in a predetermined direction of rotation 110 about a longitudinal rotation axis 101, in particular oriented along a horizontal direction, or substantially horizontal. In particular, the first and second folding rolls 1*a* and 1*b* are counter-rotating. The first and the second folding or interfolding rolls, 1*a*, or 1*b* are, furthermore, provided, respectively, with a plurality of mechanical gripping groups 30, each of which comprising a mechanical gripping member 15, in the following also called "pliers member". More precisely, each pliers member 15 is configured to move, at a gripping point P1" having a first predetermined angular position, from an opening position to a closing position, in which is arranged to mechanically hold the or each sheet 5 up to a releasing point P2" having a second predetermined angular position in which is arranged to release the sheet 5.

Still as diagrammatically shown in FIG. 1 the folding or interfolding unit 100 can provide, furthermore, a first and a second plurality of detaching fingers 40*a* and 40*b* configured to cause the aforementioned plurality of sheets of paper 5 to be detached from the external surface 11 of a respective folding or interfolding roll 1*a* and 1*b*. In particular, the first and the second pluralities of detaching fingers 40*a* and 40*b* are advantageously moved in phase with the folding or interfolding rolls 1*a* and 1*b*, in such a way that it can, alternatively laterally and/or vertically move towards the or each worked sheet 5, and move the same away from the respective roll 1*a*, or 1*b*, thus causing the same to be "detached" from the surface of the roll to which it adheres.

In particular, still as diagrammatically shown in FIG. 1, the folding or interfolding machine equipped with the folding or interfolding unit 100, according to the invention, furthermore, provides a separation group comprising a first and a second plurality of separation members 45*a* and 45*b*, configured to enter from opposite sides into a completed stack of folded or interfolded sheets 150*a*, and to separate the same from a following stack of folded or interfolded sheets, not shown in the figure for simplicity. More in particular, a displacement unit, not shown in the figure for simplicity, is provided configured to displace the separation members 45*a* and 45*b*between a first and a second position along a predetermined back and forth displacement trajectory with respect to the respective folding or interfolding rolls 1*a* and 1*b*.

According to the present invention each gripping group 30 comprises, furthermore, at least one suction hole 16. In particular, the or each suction hole 16 is arranged to cause the, or each, sheet of paper 5 to be sucked in order to introduce the same into the pliers member 15. More in particular, the or each suction hole 16 can be pneumatically connected to a device for generating a predetermined vacuum degree, not shown in the figure for simplicity reasons, through a vacuum distribution device. This latter is configured to selectively pneumatically connect a suction hole 16 of the first or second folding or interfolding roll, 1*a*, or 1*b*, to the aforementioned device for generating a predetermined vacuum degree and to cause the, or each, sheet to be sucked between a position of starting suction P1' and a position of ending suction P2'. In particular, the or each suction hole 16 can be pneumatically connected to the aforementioned device for generating a predetermined vacuum degree between a point of starting suction P1' preferably positioned upstream of the gripping point and a point of ending suction P2' positioned upstream or downstream, of the releasing point. Generally, the suction hole 16 is, advantageously, positioned within the external lateral surface 11 of the respective folding or interfolding roll, 1*a,* or 1*b*.

The particular technical solution provided by the present invention allows, with respect to the prior art solutions, to work the sheets 5 in order to fold or interfold them, at a high velocity, also higher than 300 m/min, in particular because the mechanical gripping members 15 associated to the aforementioned suction holes 16 are able to take and release the or each worked sheet 5 at extremely accurate angular positions besides exerting a higher gripping strength on the, or each, sheet 5. Furthermore, the present solution allows to avoid the use of wedges, or other mechanical introduction members, to introduce the sheets of paper into the gripping members 15.

Figure 2:
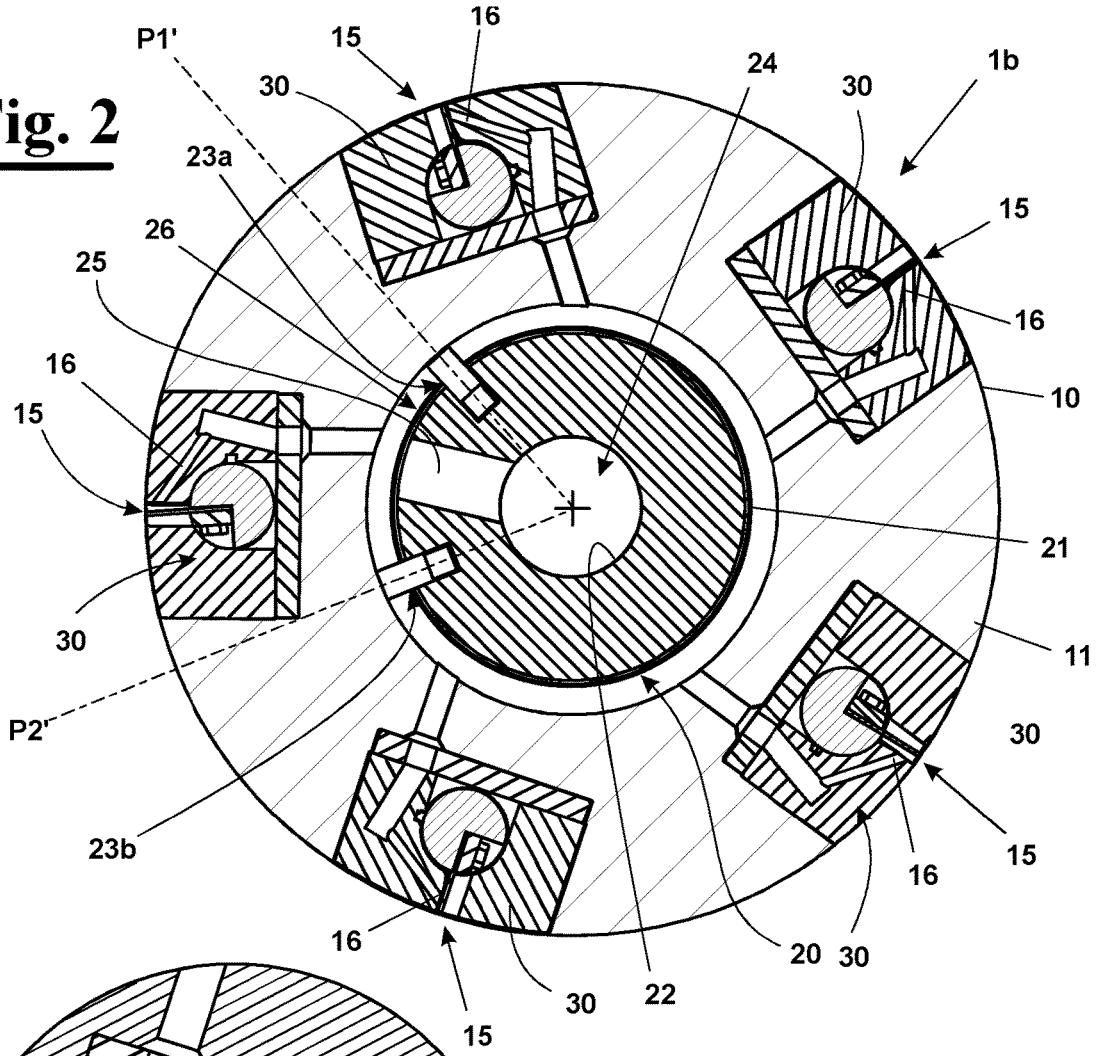

As for example diagrammatically shown in FIG. 2, in a preferred embodiment of the invention, each folding or interfolding roll, 1*a* and 1*b* comprises, furthermore, a fixed tubular body 20 positioned coaxially to the tubular body 10. The fixed tubular body 20, preferably cylindrical, is, in particular, provided with an external lateral surface 21 and an internal lateral surface 22 pneumatically connected one another by at least an aperture 25, in particular a longitudinal aperture, and a longitudinal cavity 24 pneumatically connected to the aforementioned device for generating a predetermined vacuum degree.

More precisely, the vacuum distribution device comprises a suction chamber 26 pneumatically connected to the longitudinal cavity 24 and delimited by an internal lateral surface 12 of tubular body 10 and, laterally, by a first and a second sealing member 23*a* and 23*b* arranged to extend longitudinally tubular body 10, in to the particular along respective radial directions. More in particular, the suction chamber 26 is configured to selectively pneumatically connect the aforementioned longitudinal cavity 24 to at least one suction hole 16 at a time between the aforementioned predetermined angular positions P1' and P2', in such a way to cause the, or each, sheet to be sucked by the roll 1*a,* or 1*b* and, therefore, to assist the pliers member 15 to grip the same.

In particular, the machine equipped with the folding unit 100 as described above is arranged to operate as "multi-fold" machine, in particular to produce "Z", or "W", interfolded products or even more panels. As known, in this type of paper converting machines a single web of paper is worked and a succession of sheets, which are already partly overlapped to each other, arrives to the folding or interfolding unit from one only direction.

According to an embodiment of the invention, the external surface 11 of each folding or interfolding roll 1*a,* or 1*b,* can be, furthermore, provided with a plurality of lateral suction holes 3 distributed longitudinally to the aforementioned tubular body 10. In particular, the aforementioned lateral suction holes 3, preferably oriented along respective radial directions, are selectively operated by a secondary vacuum distribution device. More in particular, the secondary vacuum distribution device is configured to selectively connect at least one row of the aforementioned rows of lateral suction holes 3 to the aforementioned device for generating a predetermined vacuum degree, or with a supplementary device for generating a predetermined vacuum degree, at a predetermined second portion of the surface 11 of the folding or interfolding roll, 1*a,* or 1*b,* comprised preferably between a point positioned upstream of, or coincident with, the point of starting suction P1' and a point positioned downstream of, or coincident with, the point of ending suction P2'.

Figure 4:
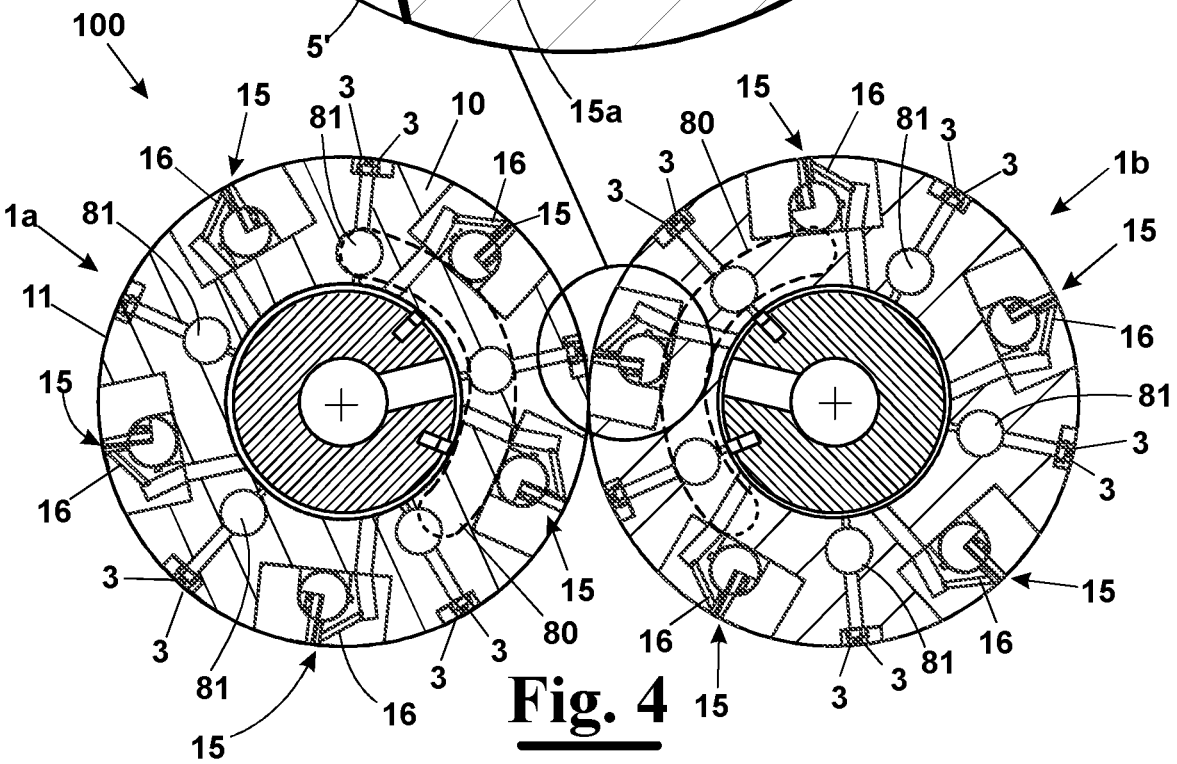
FIG. 4 diagrammatically shows a possible alternative embodiment of the folding or interfolding unit of FIG. 1 foreseen by the invention.

In particular, as diagrammatically shown in FIG. 4, each secondary vacuum distribution device can provide a longitudinal channel 81 made within the tubular body 10 pneumatically connected and associated respectively to the series of lateral suction holes 3, a shaped cavity, or lateral suction sector 80, associated to the tubular body 10 of each folding or interfolding roll 1*a,* or 1*b,* whose position is diagrammatically indicated in FIG. 4 with a broken line. More in particular, the lateral suction section 80 can be permanently connected to the secondary device for vacuum generating to selectively connect the rows of lateral suction holes 3. More precisely, by the lateral suction sector 80 associated to the tubular body 10, the rows of lateral holes 3 can be pneumatically connected with the aforementioned device for vacuum generating, only at determined angular positions of the holes. The lateral suction sector 80 is normally fixed, i.e. it does not rotate together with the tubular body 10, but can be movable, i.e. rotating about an axis coaxial to that of the tubular body 10, to carry out adjustments in such a way to modify the point of starting suction and the point of ending suction of the lateral suction holes 3. More in particular, the aforementioned lateral suction sectors 80 can be "bell" vacuum distributors coaxially arranged at an end of the tubular body 10 of each folding or interfolding roll 1*a,* or 1*b.* In particular, each bell distributor device can be arranged coaxially to the tubular body 10, and is preferably fixed. Therefore, during the rotation of the tubular body 10, some zones, or sectors, are formed where the lateral suction holes 3 suck and hold, therefore, on the external surface 11 of the respective tubular body 10, at least one sheet 5, in particular at the head 5*a,* or at the tail 5*b,* of the same, some others, instead, where the sheet is not sucked (see FIG. 5). In this case, each pliers member 15 will be arranged to hold a sheet 5, in FIG. 5 the sheet 5 which is adhering to the surface 11 of the right roll 1*b*, in particular at the centre line, and at the same time the tail 5*b* and the head 5*a* of two following sheets 5' and 5" which are adhering to the surface 11 of the other roll, in FIG. 5 the left roll 1*a*, held up that instant by a respective lateral suction hole 3 of the same couple of longitudinal rows of lateral suction holes 3. In the FIGS. 6A and 6*b* a folding or interfolding unit 100 is diagrammatically shown comprising a first and a second folding or interfolding roll 1*a* and 1*b* according to the invention, in the case of a "multi-fold" machine and, therefore, not provided with the aforementioned lateral suction holes 3. In this case, the machine will be therefore able to produce "Z", or "W", interfolded products or having even more panels.

Figure 7A:
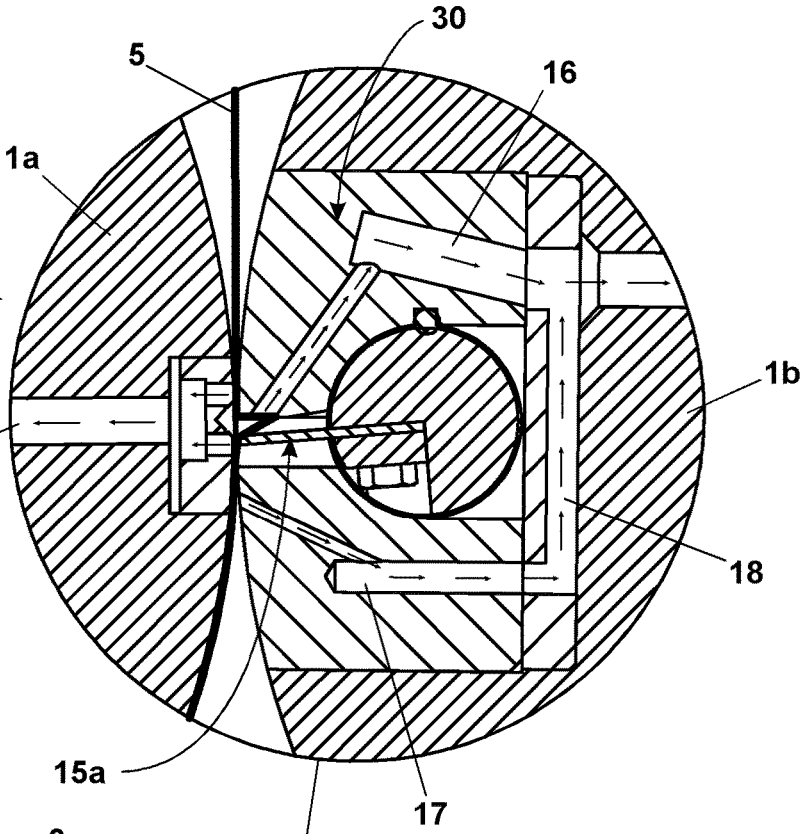
FIG. 7A diagrammatically shows still another possible alternative embodiment foreseen by the invention for the folding or interfolding unit of FIG. 1.
Figure 7B:
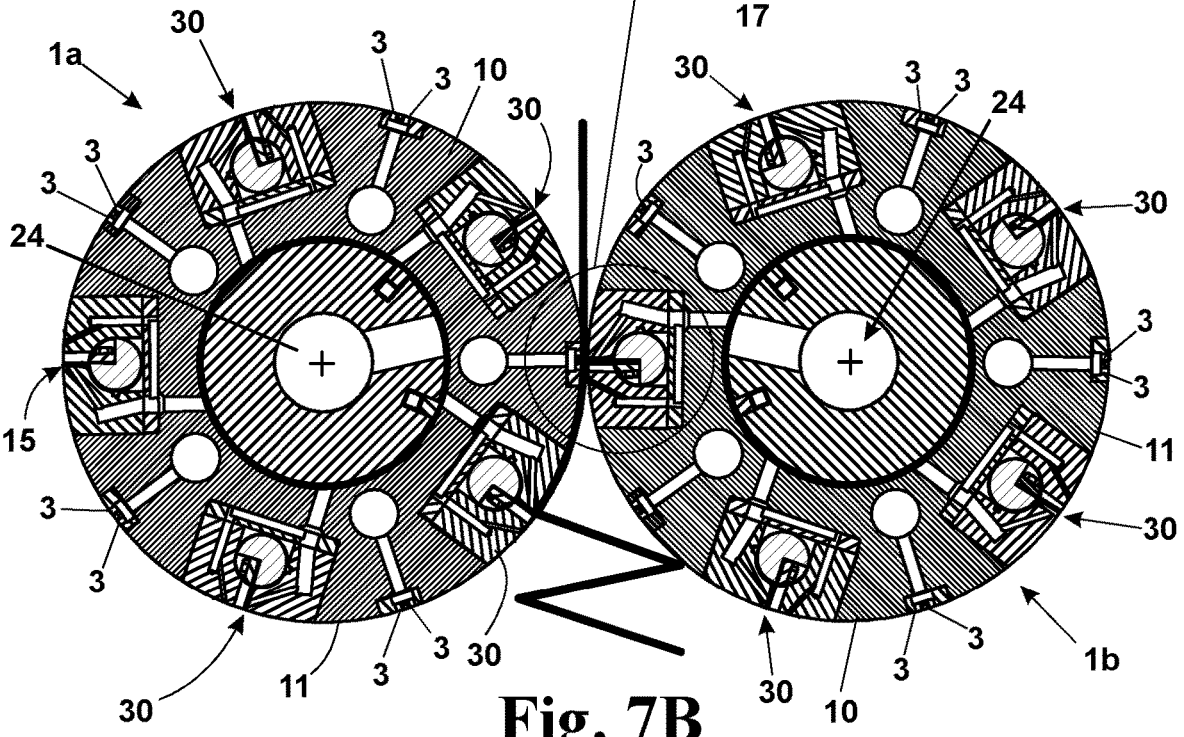
FIG. 7B shows an enlargement of the folding or interfolding zone of the folding or interfolding unit of FIG. 7A to highlight some technical characteristics.

In the embodiment diagrammatically shown in the FIGS. 7A and 7B, the folding or interfolding unit 100 comprises, instead, both the mechanical gripping groups 30 according to the invention, and the lateral suction holes 3. In this case, the folding or interfolding machine, equipped with tale folding or interfolding unit 100 will be able to work both as a "single-fold" machine, in particular for producing "V" interfolded products, and as "multi-fold" machine.

In particular, as known, the "single-fold" machines work two webs of paper, which are cut in such a way to obtain two staggered sequences of sheets that are, then, alternately fed to the folding or interfolding rolls 1*a* and 1*b*. In this way, each sheet coming from a first direction is overlapped, for half a sheet, to a portion of the sheet coming from a second direction, and vice versa, at the moment when the fold is carried out.

In an embodiment foreseen, a machine for folding or interfolding sheets of paper 5 can be equipped with a folding unit 100 comprising both the mechanical gripping groups 30 according to the invention, and the suction holes 3, and can be provided with a selection device, not shown in FIG. 9B for simplicity, configured to pneumatically disconnect, in particular by electric valves, the suction holes 3 and the aforementioned device for vacuum generating. In this case, therefore, the machine for folding or interfolding sheets of paper 5 is highly flexible because it is able to work both as "single-fold" machine by connecting the suction holes 3 to the aforementioned device for vacuum generating, and as "multi-fold" machine, in the case diagrammatically shown in FIG. 7B, by pneumatically disconnecting the suction holes 3 and the aforementioned device for vacuum generating by means of the aforementioned selection device, or simply deactivating the device for vacuum generating.

Figure 3:
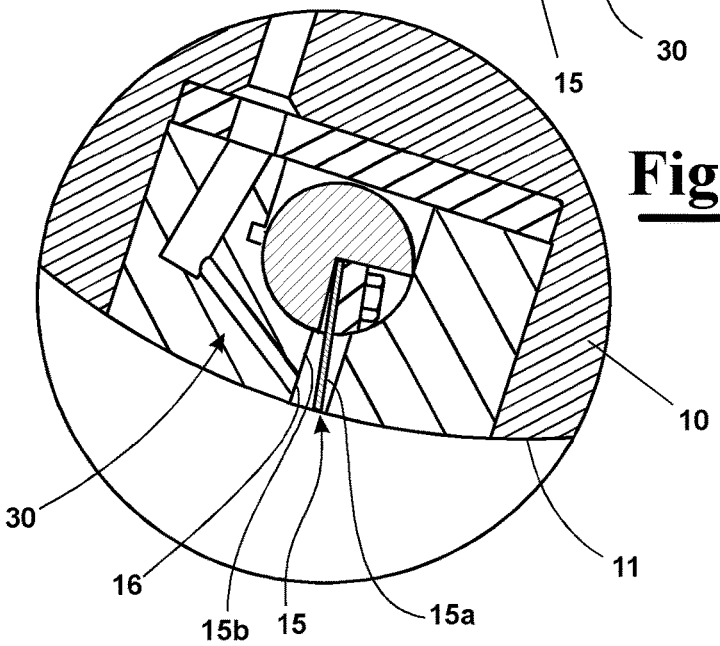
FIG. 3 shows an enlargement of a portion of the folding or interfolding roll of FIG. 2 to highlight some technical characteristics.
Figure 5:
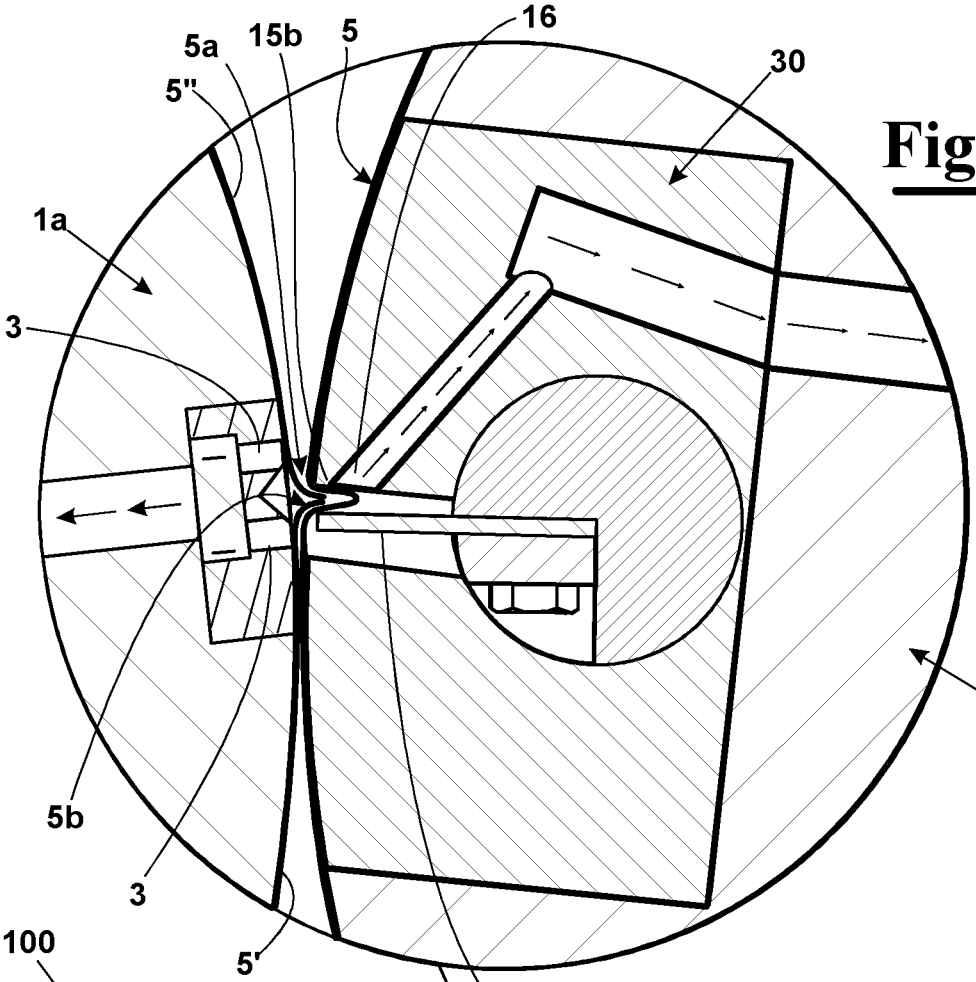
FIG. 5 shows an enlargement of the folding or interfolding zone of the folding or interfolding unit of FIG. 4 to highlight some technical characteristics.
Figure 6A:
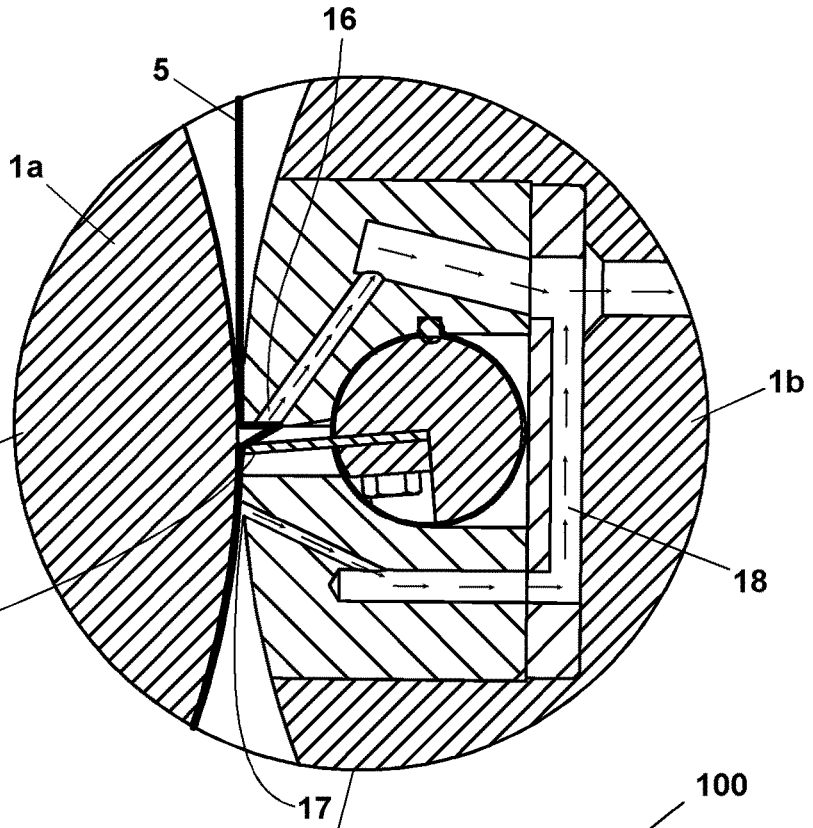
FIG. 6A diagrammatically shows another possible alternative embodiment foreseen by the invention for the folding or interfolding unit of FIG. 1.
Figure 6B:
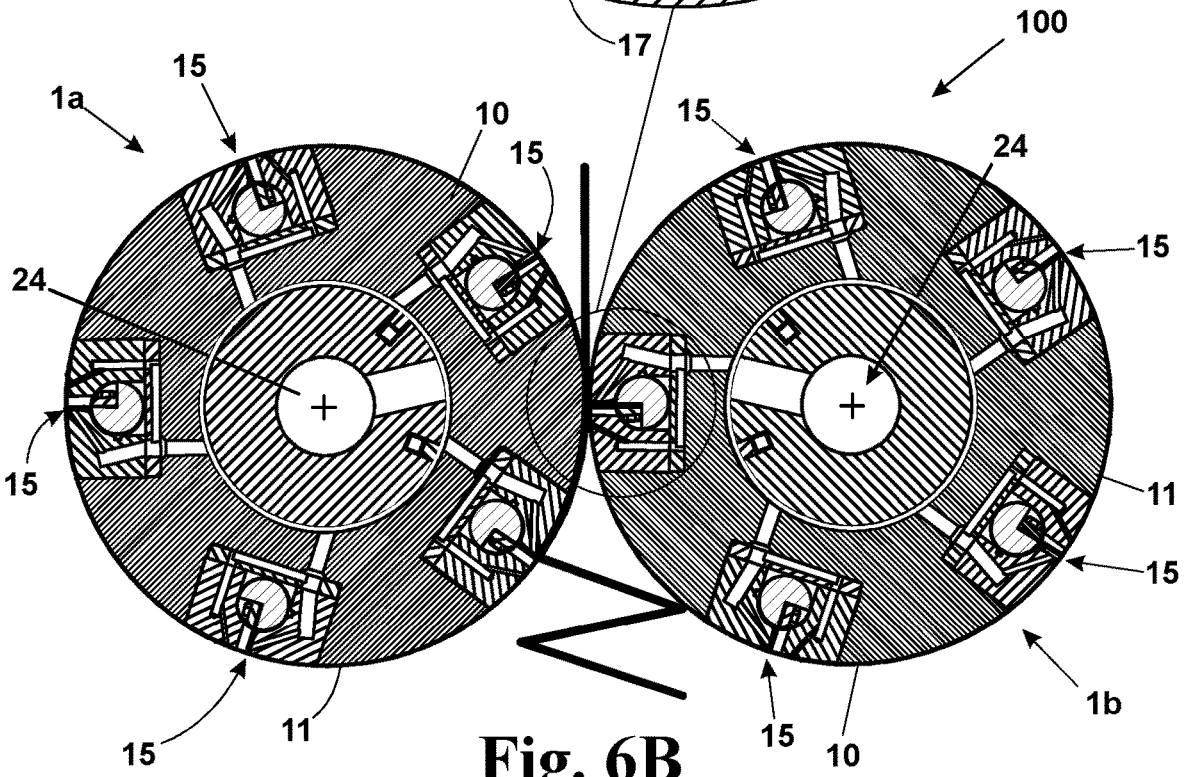
FIG. 6B shows an enlargement of the folding or interfolding zone of the folding or interfolding unit of FIG. 6A to highlight some technical characteristics.

As diagrammatically shown in the figures from 1 to 5, and in detail in the FIGS. 3 and 5, each suction hole 16 of a gripping group 30 is positioned on the fixed part 15*b* of the respective gripping member 15 and is, advantageously oriented towards the movable part 15*a* of this. In particular, each suction hole 16 is not positioned on the external lateral surface 11 of the respective folding or interfolding roll 1*a,* or 1*b,* but at an internal position with respect to the same. Preferably, each suction hole 16 is positioned at the fixed part 15*b* of a respective pliers member 15 and, advantageously, faces towards the movable part 15*a* of this.

In the alternative embodiments diagrammatically shown in the figures from 7A to 8B, each gripping group 30 according to the invention, further to the aforementioned suction hole 16, can comprise at least one secondary suction hole 17 positioned at the opposite side of the suction hole 16 with respect to the gripping member 15. In particular, each secondary suction hole 17 can be positioned at the external surface of the folding or interfolding roll 1*a,* or 1*b,* in particular downstream of the respective mechanical gripping member 15 with respect to the direction of rotation 110. More in particular, the secondary suction hole 17 can be pneumatically connected to the suction hole 16 associated to the same pliers member 15 by a connection duct 18. In this way it is possible to pneumatically connect, or disconnect, both the suction hole 16 and the secondary suction hole 17 by the same vacuum distribution device.

Figure 8:
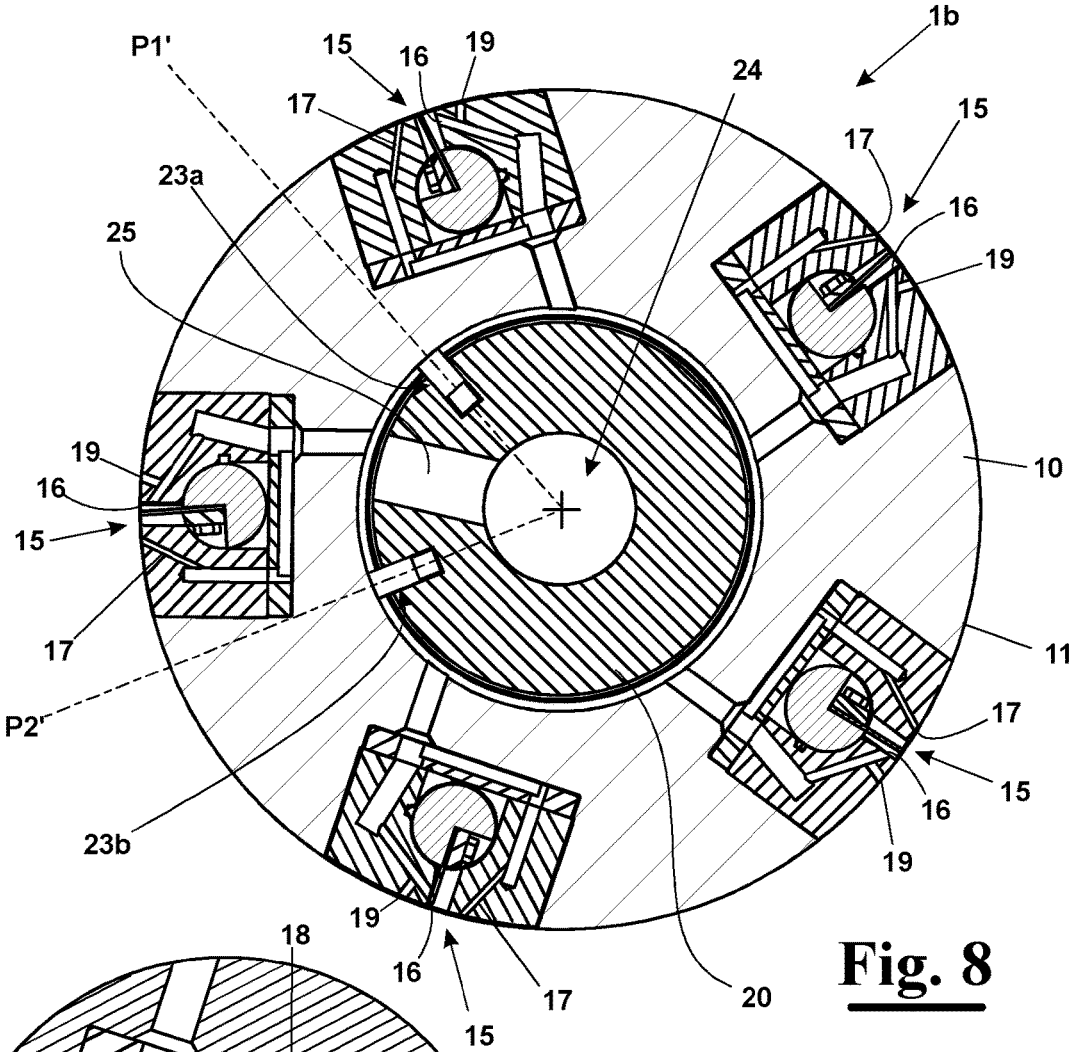
Figure 9:
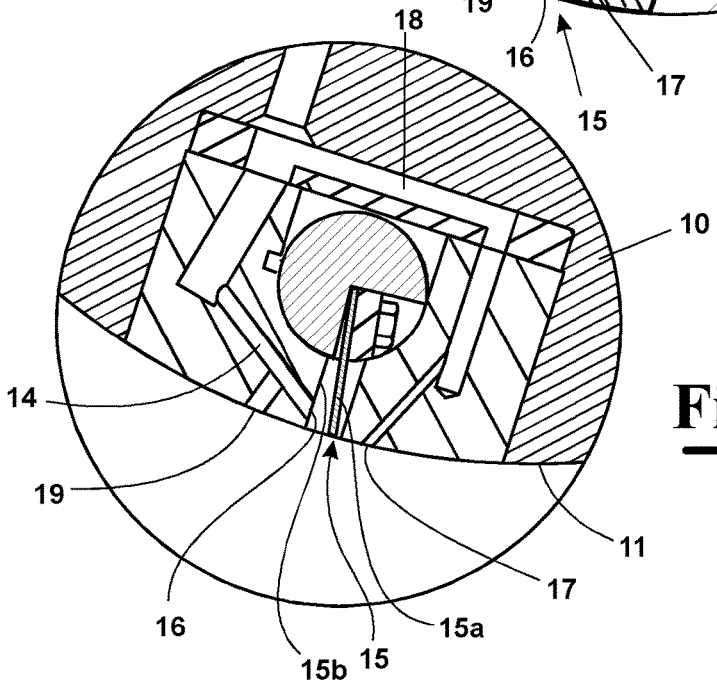
FIG. 9 shows an enlargement of a portion of the folding or interfolding roll of FIG. 8 to highlight some features.

Advantageously, in a further embodiment foreseen and diagrammatically shown in the FIGS. 8 and 9 each gripping group 30 can comprise a further auxiliary suction hole 19 positioned at the same side of the respective suction hole 16, but positioned at the external lateral surface 11 of the first and of the second folding or interfolding roll 1*a*, and 1*b*. In particular, as shown, in detail in FIG. 9, in this case, the suction duct 14 of each gripping group 30 divides into two branches, one of which ends with the suction hole 16 arranged in an "internal" position of the roll 1*a*, or 1*b* with respect to the lateral surface 11 of the same, instead the other ends with the further auxiliary suction hole 19 positioned, as anticipated above, on the surface 11 of the same roll 1*a*, or 1*b*. In particular, the further auxiliary suction hole 19 helps to stabilize the sheet 5 on the respective folding or interfolding roll 1*a*, and 1*b* assuring that it is correctly stretched on the external lateral surface 11 and introduced into the mechanical gripping member 15 for a sufficient portion.

As diagrammatically shown in the enlargements of the FIGS. 3, 5, 7 and 9, the gripping member 15 can comprise a movable part 15*a* arranged to move from/towards a fixed part 15*b* to move from a closing position to an opening position and vice versa.

The folding or interfolding unit 100, according to the invention, can comprise, furthermore, an actuation group configured to cause a pliers member 15 at a time of the aforementioned plurality of pliers members 15 to move from the opening position to the closing position and vice versa at determined angular positions of the tubular body 10 during its rotation about the longitudinal rotation axis 101.

In a possible embodiment foreseen, the aforementioned actuation group can comprise an opening device configured to selectively cause a pliers member 15 at a time to move from an opening position to a closing position at a predetermined angular position of the tubular body 10, in such a way to allow the same to hold the or each worked sheet 5. In particular, each mechanical gripping member 15 can comprise a movable part 15*a* arranged to move towards, or from, a respective fixed part 15*b*. More in particular, a closing device can be, furthermore, provided configured to cause the pliers member 15 to move from the opening position to the closing position. More precisely, the closing device and the opening device can be configured to move the movable part 15*a* of a mechanical gripping member 15 at a time from a closing position to an opening position with respect to the respective fixed part 15*b*, in such a way to allow the, or each, sheet 5 to be positioned at an engagement position arranged upstream of the movable part 15*a* of the mechanical pliers member 15. In this way, the or each sheet 5 can be arranged at an engagement position internal to the external lateral surface 11 of the tubular body 10 of the first or second folding or interfolding roll 1*a*, or 1*b*, in particular for the contemporary suction action carried out by the, or each, respective suction hole 16. Then, the closing device and the opening device are arranged to bring the pliers member 15 back from the opening position to the closing position.

As diagrammatically shown in the figures from 10A to 10D, the opening device can be a cam device 60. In particular, each pliers member 15 is operatively connected to a support shaft 63 rotatably connected to the tubular body 10, preferably by bearings, not shown for simplicity. In this way, each shaft 63 is rotationally integral with the tubular body 10, but, at the same time, is able to rotate with respect to a respective rotation axis 163, to operate the opening and closing movements of the movable part 15*a* of the respective pliers member 15.

In particular, an engagement portion, advantageously an end portion 61*a* of an actuation shaft 61 fitting on each support shaft 63. At another engagement portion, advantageously the other end portion 61*b*, the same actuation shaft 61 is arranged to support a feeler member 62, in particular of mechanical type, that is able to rotate about a respective rotation axis 162. In particular, the feeler member 62 is arranged to slide along the guide member 70, or sliding race, during the rotation of the folding or interfolding roll 1*a*, or 1*b* about its longitudinal rotation axis 101.

More in particular, the guide member 70 is a cam configured in such a way to guide the feeler member 62, and, therefore, the respective actuation shaft 61, along a predetermined trajectory. More precisely, the guide member 70 is fixed with respect to the respective folding or interfolding roll 1*a*, or 1*b*, and is arranged to cause the movable part 15*a* of the pliers member 15 to change inclination with respect to the fixed part 15*b* at predetermined angular positions to cause the aforementioned movement from the closing position to the opening position. Advantageously, the feeler member 62 can be maintained in contact with the guide member 70 by a push member 65 or can be slidingly engaged into a shaped groove, also this not shown in the figure for simplicity. For example, the feeler member 62 can be provided with a rolling member, for example a roller, or a wheel, arranged to slide along the aforementioned guide member 70.

Figure 10A:
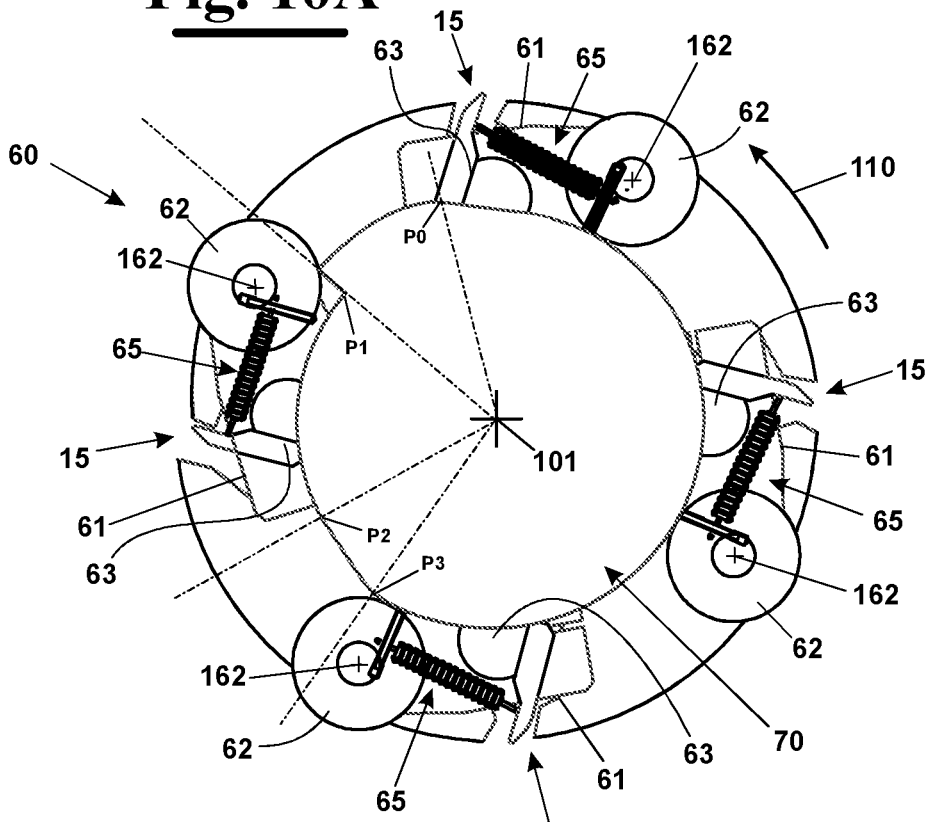
Figure 10B:
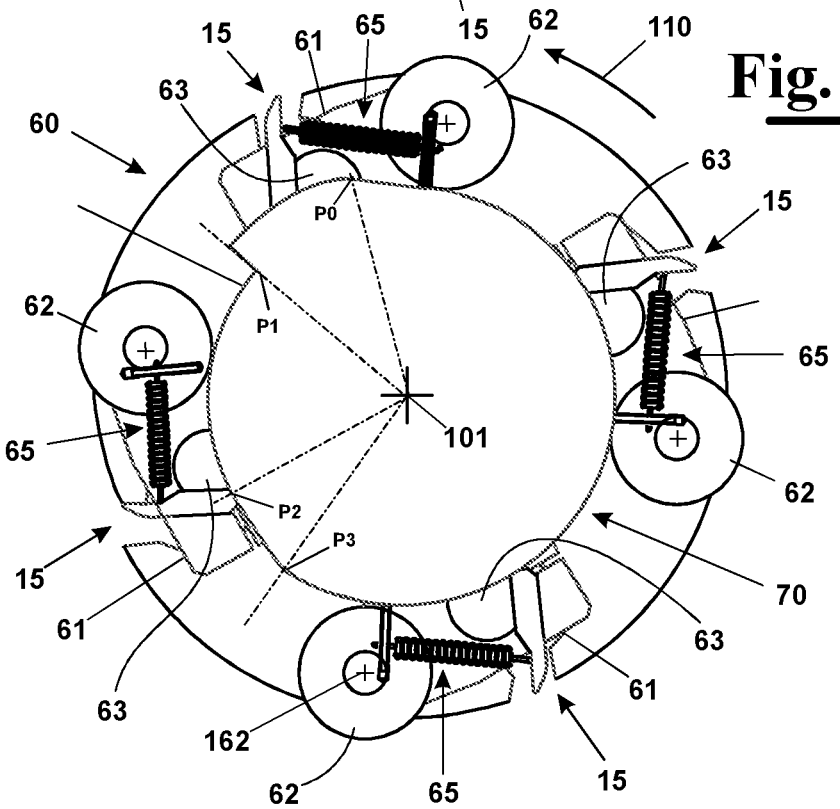

In the embodiment diagrammatically shown in the figures from 10A to 10D, the push member 65 is an elastic return member. In particular, the elastic return member 65 is configured to apply on a respective pliers member 15, in particular on the movable part 15*a* of the same, an elastic return force arranged to oppose the movement from the closing position to the opening position caused by the cam opening device 60. More precisely, the elastic strength of the return member 65 is configured to maintain the movable part 15*a* in the closing position (stretch from P1 to P2 of FIGS. 10A-10D), but is, however, less than the opening strength due to the push exerted by the guide member 70 on the feeler member 62 between the positions P3 and P0 of the guide member 70. In particular, between the point P3 and the point P0 the opening strength exceeds the elastic strength of the return member 65 and causes the actuation shaft 61, and therefore the support shaft 63, to rotate causing the pliers member 15 to rotate to be opened. More precisely, at the stretch comprised between P0 and P1 the cam opening device 60 is arranged to cause the pliers member 15 to move from a minimum opening position to a maximum opening position at point P1, where at a "step" of the guide member 70, the push strength on the feeler member 62 is suddenly reduced and the same is overcome by the elastic strength of the return member 65, which brings the pliers member 15 in the closing position at the gripping point P1" (diagrammatically shown in FIG. 10D) in which it remains until the feeler member 62 arrives at point P2, at which the pliers member 15 is in position P2" (diagrammatically shown in FIG. 10C).

In the stretch between P2 and P3, instead, the cam opening device 60 is arranged to bring the movable part 15*a* of the pliers member 15 from the closing position to the opening position, in which is far-removed from the fixed part 15*b* (as can be deduced comparing FIGS. 10C and 10D). More precisely, the cam device 60, during the sliding along the stretch comprised between P0 and P1 of the guide member 70 by the feeler member 62, progressively causes the movable part 15*b* of the gripping member 15 to move from an intermediate opening position to a maximum opening position. Then, when the feeler member 62 runs the stretch comprised between P1 and P2 the return member 65 causes the movable part 15*b* of the gripping member 15 to move in the closing position. Then, when the feeler member 62 arrives at the position P3, the guide member 70 causes the movable part 15*b* of the gripping member 15 to move from the closing position to a starting opening position and, at the end, when the feeler member 62 arrives at the position P4, the cam device 60 causes the movable part 15*b* of the gripping member 15 to move in an intermediate opening position that is maintained until the feeler member 62 arrives again at the position P0. In this way at point P2 of the feeler member 62 and therefore at point P2" of the pliers member 15, the sheet 5 as well as the tail 5*b* and the head 5*a* of two following sheets 5' and 5" are released.

According to an embodiment of the invention, the actuation group can comprise a desmodromic cam configured to cause the pliers member 15, in particular its movable part 15*a*, to move from the opening position to the closing position and vice versa, that means from the closing position to the opening position with respect to the respective fixed part 15*b*. In particular, in this case the guide member 70 comprises a stretch where is arranged to cause the movable part 15*a* to move from the closing position to the opening position and a stretch where is arranged to cause the movable part 15*a* to move from the closing position to the opening position.

Figure 11:
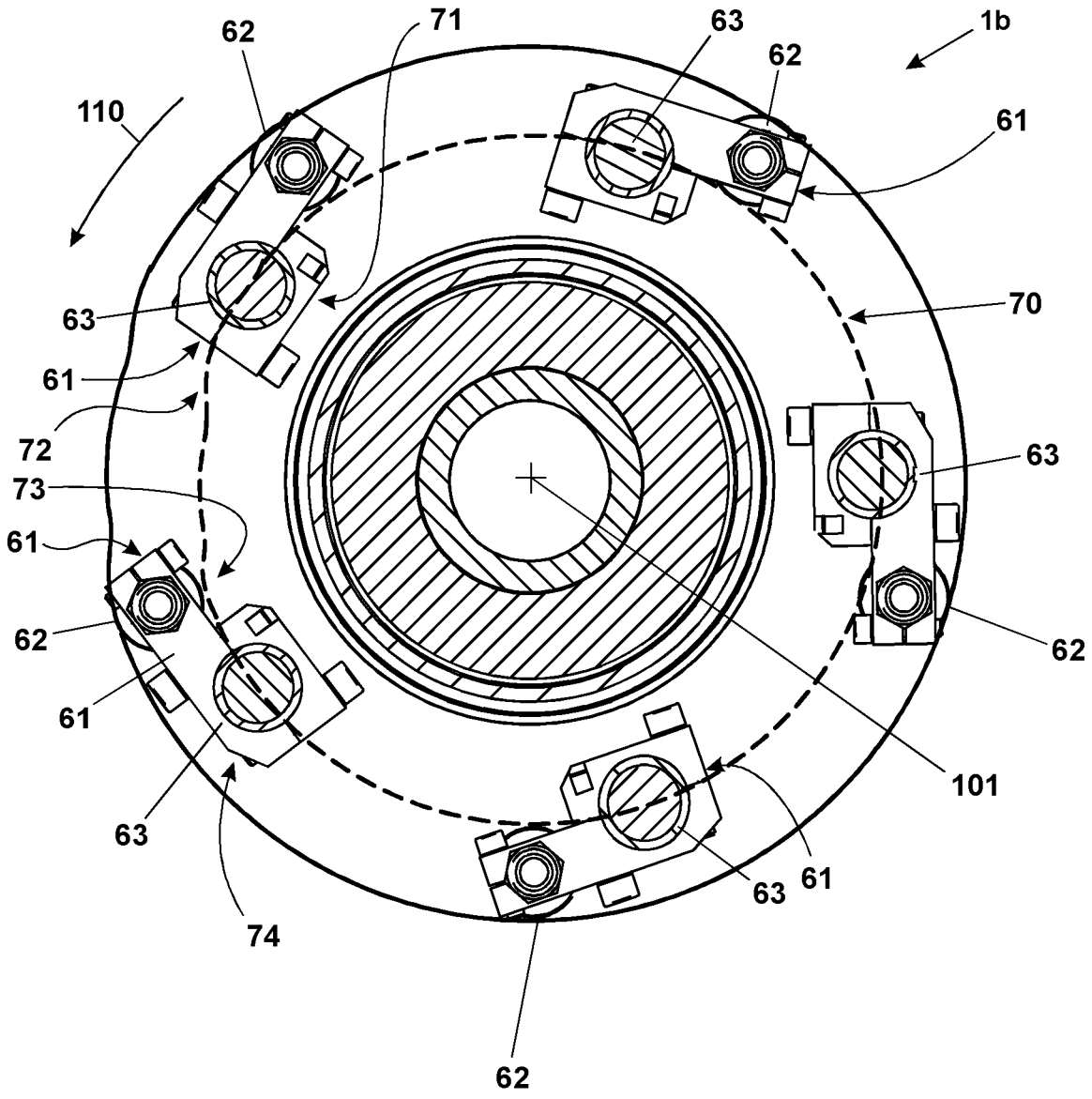
FIG. 11 diagrammatically shows a transverse section view of an alternative embodiment of the actuation group of a of a folding, or suction roll of the FIGS. 10A-10D.

As diagrammatically shown in FIG. 11, the guide member 70 can be a shaped groove in which each feeler member 62 of each arm 61 is arranged to slide in order to be guided along a predetermined trajectory, during the rotation of the respective folding or interfolding roll 1*a*, or 1*b*. In particular, each feeler member 62 can comprise a first and a second rolling member, each of which configured to slide on a respective sliding race of guide member 70, which forms the shaped groove (in FIG. 11 only one rolling member and the respective sliding race are shown for clarity reasons). In this way, the feeler member 62 can operate the opening of the pliers member 15 by interaction of the first rolling member with one of the two races of the guide member 70. Vice versa, the closing of the pliers member 15 is obtained by interaction of the second rolling member of the feeler member 62 with the second race of the guide member 70. The use of desmodromic cam allows to avoid the use of the push member 65. More precisely, the shaped groove 70 has a geometry such that when the pliers member 15 reaches a predetermined angular position P0, the movable part 15*a* begins to progressively move away, in particular by rotating, from the fixed part 15*b*. In particular, when the first rolling member of the feeler member 62 moves along an opening stretch 71 of the first race of the shaped groove 70 causes the arm 61 and, therefore, the support shaft 63 to rotate in order to cause the pliers member 15 to open. The shaped groove 70 provides, then, a closing stretch 72 of the second race a geometry such that when the second rolling member of the feeler member 62 arrives at another angular position causes the movable part 15*a* to close towards the fixed part 15*b*, in such a way to hold the or each worked sheet. Then, when during the rotation of the roll 1*a*, or 1*b*, about the respective longitudinal axis 101, the first rolling member of the feeler member 62 reaches at a following predetermined angular position of a following second opening stretch 73 of the first race of the shaped groove 70 is forced to cause again the pliers member 15 to open, in such a way to allow the same to release the sheet, and then to go back to the position far removed from the fixed part 15*b* once that a further angular position of a third opening stretch 74 of the shaped groove 70 is reached. Therefore, in this case, the opening device and the closing device are formed by respective shaped stretches of the guide member 70, in particular of the shaped groove. More precisely, analogously to what is described above with reference to the figures from 10A to 10D, at the opening stretch 71, the guide member 70 is configured in such a way to move the movable part 15*b* of the gripping member 15 from an intermediate opening position to a maximum opening position and, then, at the closing stretch 72 to cause the sudden movement in the closing position and, therefore, at the stretch 73, the movement from the closing position to a starting opening position and, at the end, at the stretch 74 in an intermediate opening position, which is maintained until it passes again the opening stretch 71.

In an embodiment foreseen, the movable part 15*a* of each pliers member 15 can be made of a flexible material, advantageously in harmonic steel, in such a way to elastically move from the closing position to the opening position and vice versa.

Figure 12:
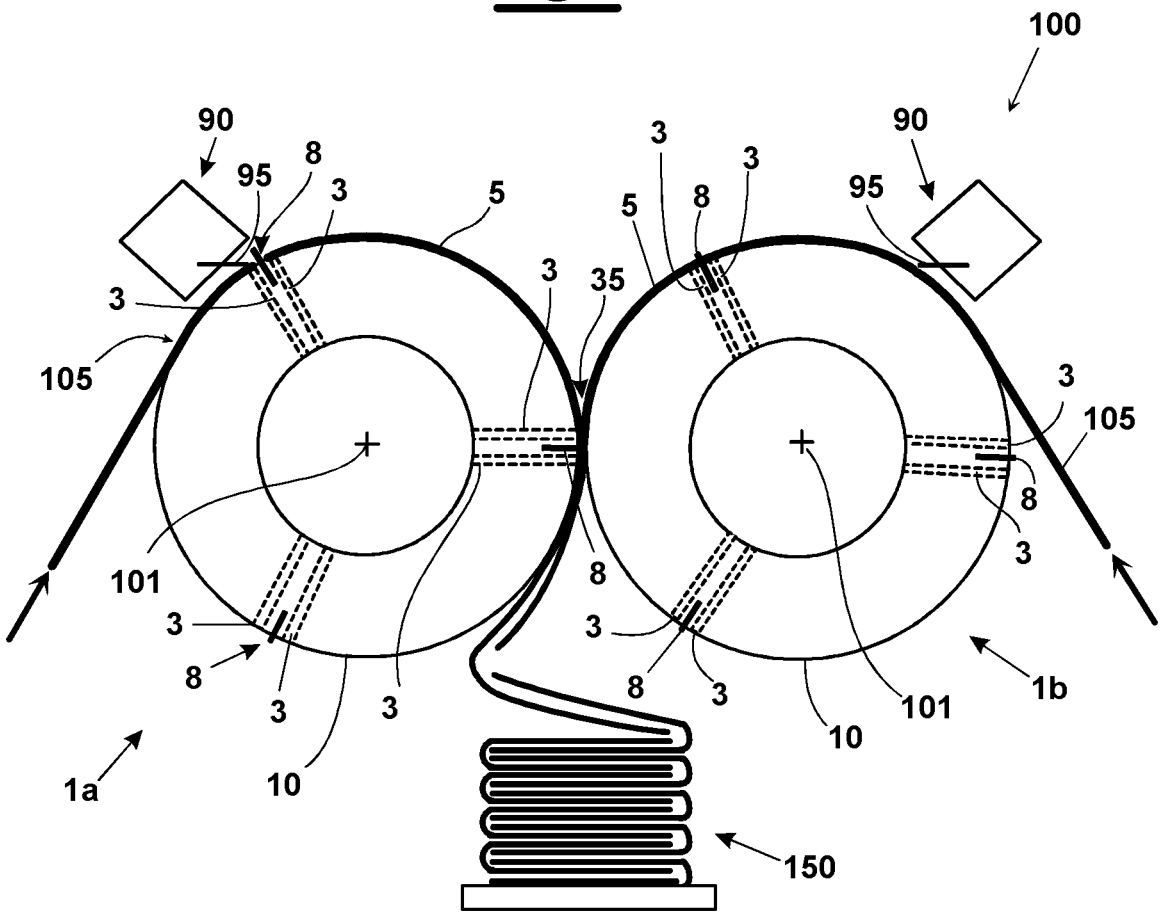
FIG. 12 diagrammatically shows a further embodiment of the invention for the folding or interfolding unit according to the invention.

In the further embodiment of the invention that is diagrammatically shown in FIG. 12, each folding or interfolding roll, 1*a* and 1*b* comprises, furthermore, a respective cutting device 90 provided with at least one cutting blade 95. In this case, each first and second folding or interfolding roll, 1*a* and 1*b* is respectively, provided, in particular between a couple of lateral suction holes 3, as diagrammatically described above with reference to the embodiments of FIGS. 4 and 8, of a first and a second plurality of counter-blades 8 distributed along the respective tubular body 10. More precisely, the counter-blades 8 of each roll 1*a* and 1*b* are arranged to cooperate with the respective cutting blade 95 to divide a first and a second web of paper 105*a* and 105*b*, or similar products, in a first and a second plurality of sheets 5. For clarity reasons, in FIG. 13 are not shown the pliers members 15 and the respective suction holes 16 which can be, anyway, of the type described above with reference to the figures from 1 to 12. In particular, in this case, the counter-blade 8 of a roll, for example of roll 1*a*, at the folding or interfolding zone, 35 can act as introduction member and, therefore, assist the introduction of the, or each, worked sheet 5 within the pliers member 15 of the other roll, for example of the roll 1*b*.

Also in the embodiment of FIG. 12 are present, but not shown for simplicity, both the first and the second plurality of detaching fingers 40*a* and 40*b* as well as the first and the second plurality of separation members 45*a* and 45*b* having the same functionality described above.

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. A folding or interfolding unit of a plurality of sheets of paper, comprising:

a first and a second folding or interfolding roll configured to fold or interfold, said plurality of sheets of paper according to a predetermined folding or interfolding configuration, at a folding or interfolding zone, each said first and second folding or interfolding roll including:

a tubular body configured to rotate in a predetermined direction of rotation about a longitudinal rotation axis oriented along a horizontal direction;

a plurality of gripping groups each of which includes:

a mechanical gripping member comprising a movable part and a fixed part, said movable part being configured to move, at a gripping point having a first predetermined angular position, from an opening position to a closing position with respect to said fixed part, in said closing position said mechanical gripping member being arranged to mechanically hold said or each sheet of said plurality of sheets up to a releasing point having a second predetermined angular position; and at least one suction hole associated to each mechanical gripping member and configured to cause said or each sheet of paper to be sucked between a position of starting suction and a position of ending suction introduce the same into said mechanical gripping member; and an actuation group configured to cause a movable element at a time to move from said opening position to said closing position and vice versa;

said actuation group including:

an opening device that is a cam device and is configured to selectively cause a movement of a movable element at a time from said closing position to said opening position, at said releasing point; and a closing device configured to cause a movable element to move from said opening position to said closing position at said gripping point;

wherein said cam device comprises a support shaft rotatably connected to a respective folding or interfolding roll, and arranged to support said movable part, each support shaft being engaged at an end portion of an actuation shaft; and wherein said cam device further comprises a feeler member arranged to engage at a second end of said actuation shaft, said feeler member being arranged to move along a fixed guide member and configured to cause said movable part to change inclination with respect to said fixed part at said gripping and releasing points to cause the same to move from said closing position to said opening position and vice versa.

2. The folding or interfolding unit according to claim 1, further comprising a first and a second plurality of detaching fingers are, furthermore, provided configured to cause said plurality of sheets of paper to be removed from an external surface of a respective folding or interfolding roll.

3. The folding or interfolding unit according to claim 1, further comprising a separation group including a first and a second plurality of separation members configured to enter from opposite sides into a completed stack of folded or interfolded sheets of paper, separating the same from a following stack of folded or interfolded sheets of paper.

4. The folding or interfolding unit according to claim 1, wherein said fixed guide member is a shaped groove and wherein said feeler member is arranged to slidingly engage in said shaped groove.

5. The folding or interfolding unit according to claim 1, wherein said closing device is an elastic return member configured to exert on said movable part an elastic return force arranged to oppose said movement from said closing position to said opening position.

6. The folding or interfolding unit according to claim 1, wherein said at least one suction hole is positioned on said fixed part of the respective mechanical gripping member.

7. The folding or interfolding unit according to claim 6, wherein each said gripping group is associated to an auxiliary suction hole positioned upstream of each said mechanical gripping member with respect to the direction of rotation of the first or second folding or interfolding roll and positioned at the external lateral surface of said first or second folding or interfolding roll.

8. The folding or interfolding unit according to claim 1, wherein said external surface of said first and second folding or interfolding roll is provided with a plurality of lateral suction holes distributed longitudinally to said respective tubular body.

9. The folding or interfolding unit according to claim 1, wherein said movable part of each mechanical gripping member is made of a flexible material.

10. The folding or interfolding unit according to claim 1, wherein said movable part is made of a harmonic steel, in such a way to elastically move from said closing position to said opening position and vice versa.

11. The folding or interfolding unit according to claim 1, wherein said fixed guide member is a shaped groove and wherein said feeler member is arranged to slidingly engage in said shaped groove.

12. A folding or interfolding unit of a plurality of sheets of paper, comprising:

a first and a second folding or interfolding roll configured to fold or interfold, said plurality of sheets of paper according to a predetermined folding or interfolding configuration, at a folding or interfolding zone, each said first and second folding or interfolding roll including:

a tubular body configured to rotate in a predetermined direction of rotation about a longitudinal rotation axis oriented along a horizontal direction;

a plurality of gripping groups each of which includes:

a mechanical gripping member comprising a movable part and a fixed part, said movable part being configured to move, at a gripping point having a first predetermined angular position, from an opening position to a closing position with respect to said fixed part, in said closing position said mechanical gripping member being arranged to mechanically hold said or each sheet of said plurality of sheets up to a releasing point having a second predetermined angular position; and at least one suction hole associated to each mechanical gripping member and configured to cause said or each sheet of paper to be sucked between a position of starting suction and a position of ending suction introduce the same into said mechanical gripping member; and an actuation group configured to cause a movable element at a time to move from said opening position to said closing position and vice versa;

said actuation group including:

an opening device that is a cam device and is configured to selectively cause a movement of a movable element at a time from said closing position to said opening position, at said releasing point; and a closing device configured to cause a movable element to move from said opening position to said closing position at said gripping point;

wherein each folding or interfolding unit further comprises:

a vacuum distribution device is, furthermore, provided configured to selectively pneumatically connect at least one suction hole of said first and second folding or interfolding rolls at a time to a device for generating a predetermined vacuum degree in such a way to cause said or each sheet of paper to be sucked between said position of starting suction and said position of ending suction; and a fixed tubular body positioned coaxially to said tubular body, said fixed tubular body being provided with an external lateral surface and an internal lateral surface pneumatically connected to each other by at least an aperture and a longitudinal cavity pneumatically connected to said device for generating a predetermined vacuum degree; and wherein said vacuum distribution device comprises:

a suction chamber pneumatically connected to said longitudinal cavity and delimited by an internal lateral surface of said tubular body and laterally by a first and a second sealing member arranged to extend longitudinally to said tubular body, said suction chamber being configured to selectively pneumatically connect said longitudinal cavity to a suction hole at a time between said first and second predetermined angular positions.

13. Folding or interfolding unit of a plurality of sheets of paper, comprising:

a first and a second folding or interfolding roll configured to fold or interfold, said plurality of sheets of paper according to a predetermined folding or interfolding configuration, at a folding or interfolding zone, each said first and second folding or interfolding roll including:

a tubular body configured to rotate in a predetermined direction of rotation about a longitudinal rotation axis oriented along a horizontal direction;

a plurality of gripping groups each of which includes:

a mechanical gripping member comprising a movable part and a fixed part, said movable part being configured to move, at a gripping point having a first predetermined angular position, from an opening position to a closing position with respect to said fixed part, in said closing position said mechanical gripping member being arranged to mechanically hold said or each sheet of said plurality of sheets up to a releasing point having a second predetermined angular position; and at least one suction hole associated to each mechanical gripping member and configured to cause said or each sheet of paper to be sucked between a position of starting suction and a position of ending suction introduce the same into said mechanical gripping member; and an actuation group configured to cause a movable element at a time to move from said opening position to said closing position and vice versa;

wherein said actuation group comprises a desmodromic cam comprising a shaped guide in which a feeler member is arranged to slidingly engage, said shaped guide comprising at least one opening stretch configured to cause said movable part to change inclination with respect to said fixed part of said gripping member to bring the same in said opening position, and at least one closing stretch arranged to cause said movable part to change inclination with respect to said fixed part of said gripping member to bring the same in said closing position.

* * * * *